United States Patent [19]

McKee

[11] Patent Number: 5,021,058

[45] Date of Patent: Jun. 4, 1991

[54] METHOD FOR RELIEVING HEADACHES AND APPARATUS FOR PRACTICING THE SAME

[76] Inventor: Charles S. McKee, 705 Lakeshore Dr., Newport, Ark. 72112

[21] Appl. No.: 243,510

[22] Filed: Sep. 12, 1988

[51] Int. Cl.[5] ..... A61H 39/02

[52] U.S. Cl. ..... 606/204; 128/907; 128/735; 606/201

[58] Field of Search ..... 272/68, 69, 93, 135, 272/136, 27 N; 128/26, 54, 59, 69, 77, 44, 25 R, 60, 907, 735; 84/465, 467; 446/311, 312; 606/200, 204, 201

[56] References Cited

U.S. PATENT DOCUMENTS

| | | | |
|---|---|---|---|
| 336,216 | 2/1886 | Debuysere | 272/67 X |
| 1,294,027 | 2/1919 | Baum | 446/312 |
| 2,476,518 | 7/1949 | Underwood | 128/26 X |
| 2,546,118 | 3/1951 | Wright | 272/67 |
| 3,378,947 | 4/1968 | Zimmerman | 446/311 X |
| 4,122,852 | 10/1978 | Knetsch et al. | 606/204 |
| 4,479,495 | 10/1984 | Isaacson | 606/204 |
| 4,549,536 | 10/1985 | Varjabedian | 606/204 |
| 4,716,898 | 1/1988 | Chauve et al. | 606/204 |
| 4,809,976 | 3/1989 | Berger | 272/136 X |
| 4,836,531 | 6/1989 | Niks | 272/67 |

*Primary Examiner*—Richard J. Apley
*Assistant Examiner*—Lynne A. Reichard
*Attorney, Agent, or Firm*—Wood, Phillips, Mason, Recktenwald & VanSanten

[57] ABSTRACT

Headaches may be relieved by separating the middle and forefinger of each hand and simultaneously applying pressure to the back of the hand side of the webs of skin extending between the bases of the middle and forefingers on each hand. An apparatus for performing the method includes a plate 10 for receiving both hands of the person suffering the headache and which is provided with a pair of spaced parallel arms 24 pivoted to the plate 10 such that corresponding ends 26 overlie the plate. Skin web engaging pads 30 are located on the ends 26.

13 Claims, 1 Drawing Sheet

METHOD FOR RELIEVING HEADACHES AND APPARATUS FOR PRACTICING THE SAME

FIELD OF THE INVENTION

This invention relates to the relief of headaches through the application of pressure to pressure points and to an apparatus for applying pressure to pressure points on the human body.

BACKGROUND OF THE INVENTION

Headaches have long been a common malady for numerous members of the human race. The causes of headaches vary from premenstrual syndrome to simple tension to overindulging in alcohol. Cures of various sorts, including drugs such as common aspirin to acupuncture techniques, abound.

However, cures involving the utilization of drugs are not for everyone. The tolerance of various individuals to particular drugs varies substantially with the result that side effects may accompany the use of particular drugs. A common example is the acidic stomach that occurs in many people with the use of aspirin which has led to the development of buffered aspirin.

Cures involving the use of acupuncture are only as available as a trained person practicing acupuncture and thus are out of reach of a large number of sufferers. Further, where the technique involves the penetration of the skin with an acupuncture needle, the danger of infection is always present.

The present invention is directed to overcoming one or more of the above problems.

SUMMARY OF THE INVENTION

It is the principal object of the invention to provide a new and improved method of curing headaches. More specifically, it is an object of the invention to provide a method for curing headaches that does not require the use of drugs and therefore is not accompanied by side effects and yet may be practiced by ordinary people without requiring any degree of training or competence in a particular field. It is also an object of the invention to provide an apparatus for practicing the method.

An exemplary embodiment of a method for curing headaches according to the invention includes the steps of separating the middle and forefingers of each hand and thereafter, simultaneously applying pressure to the back of the hand side of the webs of skin that extend between the bases of the middle and forefinger on each hand.

According to one embodiment of the method, the pressure applying step is performed by supporting the fronts of the hands on an underlying surface and exerting a downward pressure on the webs of skin.

According to another embodiment of the method, the step of applying pressure is performed by squeezing the webs of skin. This embodiment may be performed by one person squeezing the webs of skin of another between the first person's thumbs and forefingers.

The invention also contemplates an apparatus for simultaneously applying pressure to the back of the hand side of the webs of skin between the middle and forefingers of both hands. The apparatus comprises a plate for receiving both hands of a person with the middle and forefingers at least slightly spread. A pair of spaced parallel arms are pivoted to the plate such that corresponding ends of each arm overlie the plate. Skin web engaging pads are disposed on the overlying ends of the plates.

In a preferred embodiment, the arms are pivotally received in spaced apertures in the plate and have remote ends opposite the ends with pads and disposed below the plate so downward pressure applied to the plate when on an underlying surface will cause the remote ends to engage the underlying surface and the arms to pivot relative to the plate and cause the arms to move the pads toward the plate to engage the webs of skin on hands on the plate surface. The downward pressure exerted on the plate may be exerted by the hands when placed on the plate.

The invention contemplates the provision of stop means for limiting movement of the arms to thereby limit the amount of pressure that the pads may exert against the webs of skin.

In a preferred embodiment, the stop means comprises downwardly directed projections on each of the arms which are operable to engage in underlying surface on which the plate is resting to prevent the further pivoting movement.

In a preferred embodiment, yieldable spring means bias the arms to move the pads away from the plate so as to allow the hands to be readily properly placed on the plate.

In a highly preferred embodiment, there is a post on each arm and a spring interconnects the post to the plate to provide the desired biasing.

Where the plate includes spaced apertures pivotally receiving the arms, the post may extend upward from the corresponding arm through the aperture and thereby define a pivot point for the corresponding arm. The spring may be secured to the post and extend oppositely away from the pad and the corresponding arm to be connected to the plate. Preferably, the springs are coil springs and have opposed hook-like ends which are received in notches in the post and in the plate.

A preferred embodiment also contemplates the provision of finger outline indicia on the plate below each of the pads so as to indicate how the hands are to be applied to the plate.

In a preferred embodiment of the invention, the pads are separate from the arms and are mounted thereon. Preferably, the pads are formed of a relatively stiff, but resilient, foam.

Other objects and advantages will become apparent from the following specification taken in connection with the accompanying drawings.

DESCRIPTION OF THE PREFERRED EMBODIMENTS

Figure 1:
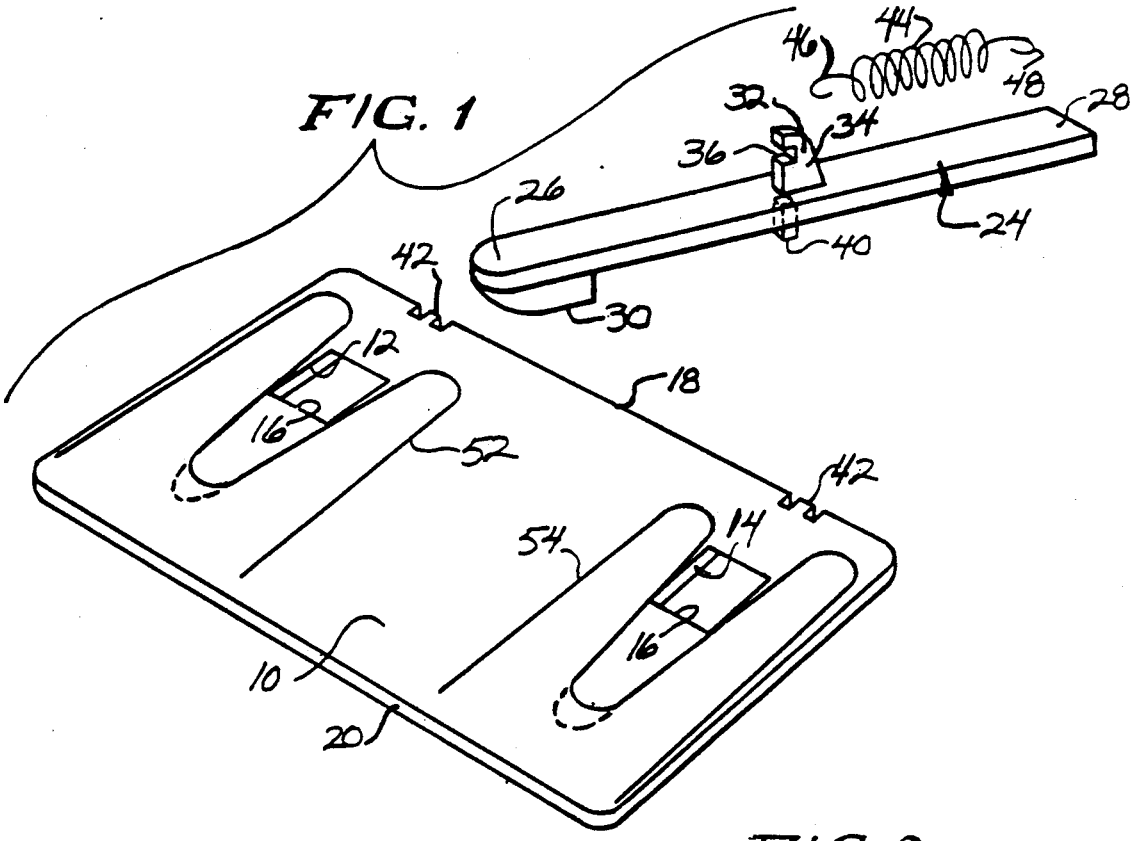
FIG. 1 is an exploded view of an apparatus made according to the invention.

A method of curing headaches according to the invention involves the application of pressure simultaneously to two points on the hands of the person suffering the headache. The actual mechanism by which the application of such pressure acts to relieve headache is not known but empirical testing has established that the method works with efficacy with a large number of headache sufferers suffering headache from a large variety of differing causes.

According to the method, the index or forefinger and middle finger of the sufferer are at least slightly separated so as to expose the web of skin that extends between the fingers at their bases. With the web thus exposed, pressure is applied to at least the back of the hand side of such web, and optionally, to the front of the hand side of such web as well. The pressure is applied to the webs on both hands simultaneously and is a relatively gentle pressure of but a few pounds per square inch, that is, insufficient to leave an impression or otherwise abrade the skin. The pressure is maintained for as long as necessary to relieve the headache. Generally speaking, it has been found that the application of pressure for between two and five minutes will alleviate the headache symptoms of most sufferers with most sufferers observing the initiation of relief at or about two and one-half minutes.

As noted, the pressure is applied to the webs on both hands simultaneously and it has been found that the pressure cannot be applied by the sufferer without an additional instrumentality. Stated another way, the pressure must be applied either by a person other than the headache sufferer or by some sort of object or apparatus under the control of the person suffering the headache.

In the case of the former, that is, the application of pressure by another person, the method may be practiced by gently squeezing both webs of skin between respective forefingers and middle fingers on each hand between the index fingers and thumbs of the person applying the pressure. In such a case, the pressure will be applied to both the back of the hand and the front of the hand sides of the webs.

Alternatively, the pressure may be applied through the use of an apparatus such as illustrated in the drawings.

Referring to FIG. 1, there is shown an apparatus for applying pressure to the back of the hand side of the webs of skin between the index or forefinger and the middle finger on both hands simultaneously. The apparatus includes a relatively thin but rigid plate 10. The plate 10 is illustrated as being generally rectangular in configuration but virtually any shape may be utilized for the purpose.

Figure 2:
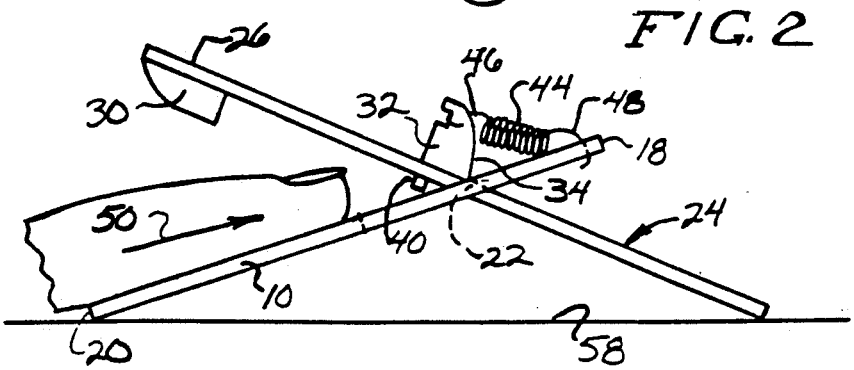
FIG. 2 is a side elevation of the apparatus at the initiation of its use.
Figure 3:
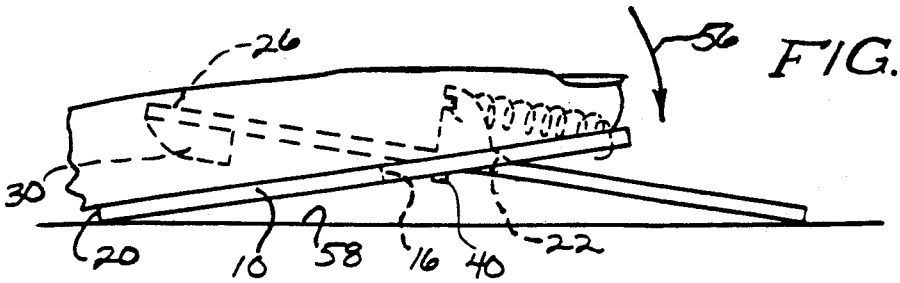
FIG. 3 is a side elevation similar to FIG. 2 but showing the apparatus in actual use.

At spaced locations, the plate 10 includes apertures 12 and 14 of generally rectangular configuration. The apertures 12 and 14 have forward edges 16 at about the mid point of the plate 10 between its edges 18 and 20. As seen in FIGS. 2 and 3, rear edges 22 of the apertures 12 and 14 may be slightly slanted if desired.

A pair of elongated arms, generally designated 24 (only one of which is shown), are provided, one for each of the apertures 12 and 14. The arms 24 typically will be on the order of six inches long and have opposite ends 26 and 28. As seen in FIG. 1, the end 26 is slightly rounded and on the underside of the arm 24 there is a web engaging pad 30. The pad 30 will preferably be made of a resilient material such as a relatively stiff foam and adhered to the end 26 by means of any suitable adhesive. As can be ascertained from FIGS. 1, 2 and 3, the surface of the pad 30 is contoured to approximate the shape of the web of skin between the forefinger and middle finger at the base thereof so as to apply pressure to such web somewhat uniformly, as opposed to locally. That is, point contact is to be avoided.

Intermediate the ends 26 and 28, each arm 24 includes an upwardly extending post 32 having a curved rear surface 34 and a forwardly opening notch 36. As can be seen in FIG. 2, the arms 24 are inserted through corresponding ones of the apertures 12 and 14 in the plate such that the posts 32 extend through the apertures with their curved surfaces 34 being in substantial abutment with the rear surfaces 22 of the corresponding apertures 12 and 14. As a consequence, the arms 24 are pivotally mounted to the plate 10 with the posts 32 defining pivot points at their point of engagement with the surface 22.

Extending from each arm 24 oppositely of the corresponding post 32 is a downward projection 40 which may serve as a stop means as will be seen.

The rear edge 18 of the plate is provided with pairs of notches 42 in general alignment with the apertures 12 and 14.

The apparatus includes a plurality of coil springs 44, one for each arm 24. Each coil spring 44 includes opposed hook-like ends 46 and 48. The hook-like end 46 may be received in the notch 36 in the projection 32 with the hook-like end 48 being received in a corresponding pair of notches 42 in the rear edge 18 of the plate. As a consequence, when the device is assembled, the spring 44 will contract and tend to pivot the arms 24 in the clockwise direction relative to the plate 10 as viewed in FIG. 2. This in turn tends to move the pad 30 of each arm 24 away from the plate 10.

As illustrated in FIG. 2, with the index and middle finger of each hand slightly spread, the same are advanced in the direction of an arrow 50 toward the rear edge of the plate 18 so that the index and middle fingers of each hand are disposed about a corresponding one of the arms 24. The final position of the fingers of each hand is illustrated by outlines 52 for the left hand and 54 for the right hand in FIG. 1. Indeed, it is preferable that indicia in the form of the outlines 52 and 54 be printed or otherwise placed on the upper surface of the plate 10 to provide an indication as to proper placement of the hands thereon.

Once the hands are properly placed on the plate 10, pressure may be applied to the plate by the tips of the fingers as illustrated by an arrow 56 appearing in FIG. 3. This causes the plate to pivot in a clockwise direction about its front edge 20 when engaged with an underlying surface 58 and in turn brings the end 28 of each of the arms 24 into engagement with the surface 58 if not already in engagement therewith. As a consequence, the arms 24 tend to pivot in a counterclockwise direction to bring the pads 20 toward the plate 10 and into engagement with the back of the hand side of the webs of skin extending between the bases of the middle and forefingers of both hands simultaneously. The downward pressure on the plate 10 is maintained for so long as pressure is required to be applied to alleviate the headache symptoms as mentioned previously.

The stops 40 act to prevent the application of excess pressure since at some point in moving the apparatus from the position of FIG. 2 toward and past that illustrated in FIG. 3, they will come into engagement with the underlying surface 58 and prevent further relative pivotal movement between the plate 10 and the arms 24. Thus, the length of the projections 40 is appropriately selected to provide the desired pressure limiting function and in some instances, a variable stop such as might be provided by a screw or the like may be utilized in lieu of the stops 40.

From the foregoing, it will be appreciated that a method of relieving headaches according to the invention is free of side effects as may be associated with cures involving drugs and may be utilized without any need for trained help. Further, the apparatus of the invention is simple and economically constructed and yet may be readily used to perform the method.

I claim:

1. Apparatus for simultaneously applying pressure to the back of the hand side of the webs of skin between the middle and forefinger of both hands comprising:

means defining a plate for receiving both hands of a person with the middle and forefingers at least slightly spread;

a pair of spaced parallel arms pivoted to said plate such that corresponding ends of each said arm overlie said plate;

skin web engaging pads on said ends; and said plate, said arms and said pads being oriented so that pressure applied to said plate by hands placed thereon will cause said arm ends and said pads to move towards said plate and to engage and apply pressure to the skin webs of the hands on the plate.

2. The apparatus of claim 1 wherein said arms are pivotally received in spaced apertures in said plate and have remote ends opposite the ends with said pads disposed below said plate so that downward pressure applied to said plate when on an underlying surface will cause said remote ends to engage the underlying surface and said arms to pivot relative to said plate and cause said arms to move said pads toward said plate.

3. The apparatus of claim 2 further including stop means for limiting movement of said arms.

4. The apparatus of claim 3 wherein said stop means comprises a downwardly directed projection on each said arm and operable to engage an underlying surface to prevent further pivoting movement of the corresponding arm.

5. The apparatus of claim 1 further including yieldable spring means for biasing said arms to move said pads away from said plate.

6. The apparatus of claim 1 including a post on each said arm and springs interconnecting said posts and said plate.

7. The apparatus of claim 1 wherein said plate includes spaced apertures pivotally receiving said arms, and an upwardly extending post on each said arm extending through the aperture in which the corresponding arm is received to define a pivot point for the corresponding arm.

8. The apparatus of claim 7 further including a spring secured to each said post and extending oppositely away from the pad on the corresponding arm and connected to said plate.

9. The apparatus of claim 8 wherein said springs are coil springs having opposed hook-like ends received in notches in said posts and in said plate.

10. The apparatus of claim 1 further including finger outline indicia on said plate below each of said pads.

11. The apparatus of claim 1 wherein said pads are separate from said arms and are mounted thereon.

12. The apparatus of claim 11 wherein said pads are formed of a relatively stiff but resilient foam.

13. The apparatus of claim 1 wherein each of said arms is sufficiently narrow as to be locatable between the index finger and middle finger on a human hand.

* * * * *